US007505729B2

(12) United States Patent
Honda et al.

(10) Patent No.: US 7,505,729 B2
(45) Date of Patent: Mar. 17, 2009

(54) CLEANING APPARATUS AND ELECTROPHOTOGRAPHIC IMAGE FORMING APPARATUS PROVIDED THEREWITH

(75) Inventors: Mitsunobu Honda, Osaka (JP); Masahito Ishino, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 363 days.

(21) Appl. No.: 11/369,762

(22) Filed: Mar. 8, 2006

(65) Prior Publication Data

US 2006/0204297 A1 Sep. 14, 2006

(30) Foreign Application Priority Data

Mar. 9, 2005 (JP) ..... 2005-065191

(51) Int. Cl.
*G03G 21/00* (2006.01)

(52) U.S. Cl. ..... 399/349; 399/351; 399/358

(58) Field of Classification Search ..... 399/349, 399/353, 354, 357, 358, 351
See application file for complete search history.

(56) References Cited

U.S. PATENT DOCUMENTS 6,272,302 B1 * 8/2001 Yamamoto ..... 399/357
6,564,034 B1 * 5/2003 Abe ..... 399/349
7,177,582 B2 * 2/2007 Ohta et al. ..... 399/358
2003/0152407 A1 * 8/2003 Hatano ..... 399/358

FOREIGN PATENT DOCUMENTS

JP 05053434 A * 3/1993
JP 2000112313 A * 4/2000
JP 2003-098924 4/2003
JP 2004-101816 4/2004

* cited by examiner

*Primary Examiner*—David M Gray
*Assistant Examiner*—Laura K Roth
(74) *Attorney, Agent, or Firm*—Smith, Gambrell & Russell, LLP

(57) ABSTRACT

A cleaning apparatus 30 is provided with a cleaning roller 33 that is a rotating member, a scraper 35, a partition wall 36, opening/closing members 37, and a discharge screw 38 that is a discharging member. The scraper 35 supported by the partition wall 36 scrapes toner by bringing the tip thereof into contact with the cleaning roller 33. The partition wall 36 has a plurality of openings 36*a*, and partitions between a space S1 formed on an upstream side of the cleaning roller 33 in a rotation direction of a drum and a space S2 in which the discharge screw 38 is provided. The opening/closing members 37 are individually provided for the openings 36*a* so as to permit toner to move through the openings 36*a* only in a direction from the space S1 to the space S2. With this structure, it is possible to make toner present in the vicinity of the cleaning roller 33 smoothly move toward the discharge screw 38.

4 Claims, 9 Drawing Sheets

CLEANING APPARATUS AND ELECTROPHOTOGRAPHIC IMAGE FORMING APPARATUS PROVIDED THEREWITH

This application is based on Japanese Patent Application No. 2005-065191 filed on Mar. 9, 2005, the contents of which are hereby incorporated by reference.

BACKGROUND OF THE INVENTION

1. Field of the Invention

The present invention relates to a cleaning apparatus that cleans the surface of an image carrying body by removing toner remaining thereon after transferring a toner image to paper, and to an image forming apparatus provided with the cleaning apparatus.

2. Description of Related Art

In electrophotographic image forming apparatuses, a widely-used method of transferring a toner image to paper is as follows. A transfer region is formed by making a photoconductor drum, which is an image carrying body, and a transfer roller, which is a transfer member, come into contact with each other, or by bringing them close to each other, and then paper is inserted through the transfer region thus formed, thereby transferring a toner image formed on the surface of the photoconductor drum to paper.

With such a transfer method, however, residual toner may result because there is a possibility that a small amount of toner is not transferred to paper and remains on the surface of the photoconductor drum after a toner image is transferred to the paper. The residual toner remaining on the surface of the photoconductor drum hampers the formation of next new images, and therefore should be cleaned therefrom. As cleaning methods for the above-described purposes, a method of recovering the residual toner by pressing a rotating member such as a cleaning roller or a rotating brush against the surface of the photoconductor drum and moving the residual toner to the rotating member, a method of scraping the residual toner off the surface of the photoconductor drum by making a cleaning blade come into contact therewith, and a cleaning method obtained by combining the above two methods are widely known.

On the other hand, when an amorphous silicon photoconductor is used as the photoconductor, there often occurs image deletion that disturbs an electrostatic latent image by absorption of moisture by electrical discharge products formed on the surface of the photoconductor. It is for this reason that a cleaning method is known that not only removes residual toner from the surface of the photoconductor by using a cleaning roller, which is a rotating member, in combination with a cleaning blade, but also scrubs the electrical discharge products off the surface of the photoconductor with toner in which a small amount of abrasive is mixed by making the cleaning roller carry a small amount of toner.

Examples of these cleaning apparatuses that remove the residual toner on the surface of the photoconductor drum by using a rotating member or a cleaning blade are disclosed in JP-A-2003-98924 (hereinafter referred to as Patent Publication 1) and JP-A-2004-101816 (hereinafter referred to as Patent Publication 2).

In the cleaning apparatus disclosed in Patent Publication 1, toner removed from the surface of a photoconductor drum and then attached to the surface of a cleaning roller is scraped therefrom by a scraper that is brought into contact with the cleaning roller by pressurizing, thereby permitting the toner thus scraped to move in a space provided between the cleaning roller and a discharging member. With this structure, however, when the toner that has started moving from the cleaning roller toward the discharging member does not reach the discharging member, it accumulates on the surface of the cleaning roller. As a result, the toner used for cleaning constantly comes into contact with the surface of the photoconductor drum, which may lead, for example, to solidification of toner or toner adhesion to the surface of the drum. Worse yet, there is a possibility that the contact pressure between the cleaning roller or the cleaning blade and the photoconductor drum increases due to accumulation of toner, affecting the cleaning performance of these members.

In the cleaning apparatus disclosed in Patent Publication 2, toner removed from the surface of the photoconductor drum and then attached to a cleaning brush is made to fly toward toner recovering and transporting means (a discharging member) by flipping the brush fibers. With this structure, however, when the toner flying from the cleaning brush does not reach the toner recovering and transporting means, it falls to the surface of the cleaning brush again, and then accumulates on the surface of the cleaning brush or the photoconductor drum. Therefore, there is a high possibility that the same problem as in the case of Patent Publication 1 arises.

SUMMARY OF THE INVENTION

In view of the conventionally experienced problems described above, it is an object of the present invention to provide a cleaning apparatus that can maintain suitable cleaning performance of cleaning the surface of an image carrying body by reliably sending unwanted toner toward a discharging member as speedily as possible without allowing toner removed from the surface of the image carrying body to keep in contact with the surface of the image carrying body and accumulate thereon, or without allowing toner used for cleaning of the surface of the image carrying body to make contact with the image carrying body again. Another object of the present invention is to provide a high-performance image forming apparatus provided with such a cleaning apparatus.

To achieve the above objects, a cleaning apparatus of the present invention is provided with: a housing; a rotating member that removes toner attached to a surface of an image carrying body by making contact with the image carrying body; a scraper that scrapes toner off a surface of the rotating member; a discharging member that discharges the toner scraped off the rotating member outside the housing; a partition wall that supports the scraper, has openings in part thereof, and partitions a space inside the housing into a space formed on an upstream side of the rotating member in a rotation direction of the image carrying body and a space in which the discharging member is provided; and an opening/closing member that is attached to each opening of the partition wall so as to permit toner to move through the opening only in a direction toward the discharging member.

With this structure, it is possible to make toner used for cleaning of the surface of the image carrying body and then scraped from the rotating member by the scraper smoothly move toward where the discharging member is provided. This makes it possible to prevent toner removed from the surface of the image carrying body from keeping in contact with the surface of the image carrying body and accumulating thereon, or toner used for cleaning of the surface of the image carrying body from making contact with the image carrying body again. Moreover, it is possible to retain an appropriate amount of toner in the space formed by the partition wall inside the housing on an upstream side of the rotating member in the rotation direction of the image carrying body without overflowing it. In this way, unwanted toner is reliably sent toward the discharging member as speedily as possible, making it possible to maintain suitable cleaning performance of cleaning the surface of the image carrying body.

According to the present invention, in the cleaning apparatus structured as described above, the discharging member and the rotating member are disposed so as to be level with each other. Alternatively, the discharging member is disposed above the level of the rotating member.

With this structure, unlike the conventional structure allowing toner to free-fall from the rotating member toward the discharging member, it is possible to make toner scraped from the rotating member smoothly move toward where the discharging member is provided, regardless of how the discharging member and the rotating member are disposed in the up/down direction. This makes it possible to maintain suitable cleaning performance of cleaning the surface of the image carrying body without being influenced by the structure of the cleaning apparatus or the disposition thereof with respect to the image carrying body, making it possible to cope with the recent trend for making an image forming apparatus increasingly compact.

According to the present invention, in the cleaning apparatus structured as described above, the scraper and the partition wall are integrated together into a single member.

With this structure, it is possible to reduce the number of parts and simplify the assembly procedure. This makes it possible to realize a structure, without a great increase in cost, that can prevent toner removed from the surface of the image carrying body from keeping in contact with the surface of the image carrying body and accumulating thereon, or toner used for cleaning of the surface of the image carrying body from making contact with the image carrying body again.

According to the present invention, in the cleaning apparatus structured as described above, the rotating member rotates in a direction in which the portion of the surface thereof where the rotating member comes into contact with the image carrying body moves in a direction different from a direction of the surface of the image carrying body, or rotates at a slower velocity than the surface of the image carrying body in a direction in which the portion of the surface of the rotating member where the rotating member comes into contact with the image carrying body moves in the same direction as the surface of the image carrying body.

This structure makes it easier to retain toner in the space formed by the partition wall inside the housing on an upstream side of the rotating member in the rotation direction of the image carrying body. As a result, even when only a small amount of toner remains on the surface of the image carrying body, it is possible to use the retained toner for cleaning of the surface of the image carrying body. This makes it possible to prevent reduction in cleaning performance. Furthermore, when spherical toner is used that can be expected to offer high image quality but has a high possibility of reducing the cleaning performance, it is possible to feed a large amount of toner retained in the space to a nip between the image carrying body and the rotating member. Thus, also in this case, the structure of the present invention is highly effective as in the case where only a small amount of toner is available.

According to the present invention, the cleaning apparatus structured as described above is provided to an image forming apparatus.

With this structure, unwanted toner is reliably sent toward the discharging member as speedily as possible without allowing toner removed from the surface of the image carrying body to keep in contact with the surface of the image carrying body and accumulate thereon, or without allowing toner used for cleaning of the surface of the image carrying body to make contact with the image carrying body again. This makes it possible to obtain a high-performance image forming apparatus that can maintain suitable cleaning performance of cleaning the surface of the image carrying body.

DETAILED DESCRIPTION OF PREFERRED EMBODIMENTS

Hereinafter, embodiments of the present invention will be described with reference to FIGS. 1 to 9.

Figure 1:
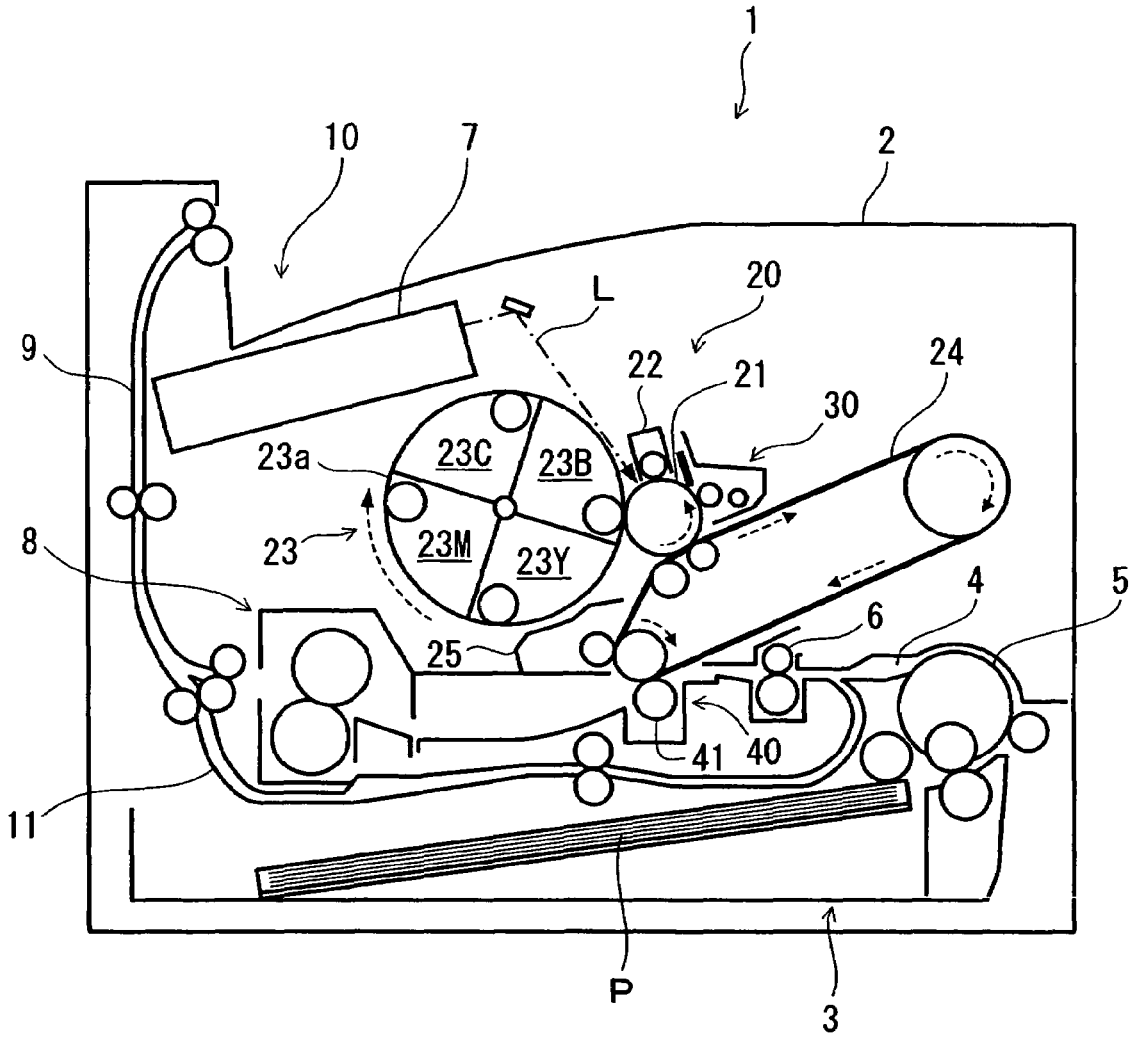
FIG. 1 is a schematic vertical sectional left side view showing the printer provided with the cleaning apparatus of embodiments of the present invention.

First, the schematic structure of the image forming apparatus provided with the cleaning apparatus of the embodiments of the present invention will be described with reference to FIG. 1. FIG. 1 is a schematic vertical sectional left side view showing the schematic structure of a color printer, which is an example of the image forming apparatus. This color printer is a type of printer that uses an intermediate transfer belt. In FIG. 1, a front face of the printer faces rightward, and a back face thereof faces leftward.

As shown in FIG. 1, a paper cassette 3 is located inside a main body 2 of a printer 1 in the lower portion of the main body 2. The paper cassette 3 accommodates a stack of paper P. In FIG. 1, the paper P is sent to the upper right of the paper cassette 3. The paper cassette 3 can be horizontally pulled out from the front face of the main body 2, that is, from the right-hand side of FIG. 1.

A feeding paper transportation path 4, a paper feeding transportation roller 5, a resist roller 6, and an image forming portion 20 are disposed on a downstream side of the paper cassette 3 in the paper transport direction. The image forming portion 20 has, at the center thereof, a photoconductor drum 21 which is a rotating image carrying body. In FIG. 1, the photoconductor drum 21 rotates counterclockwise. There are disposed, along the rotation direction around the photoconductor drum 21, a charger 22, a developing apparatus 23, and a cleaning apparatus 30 for a drum.

The developing apparatus 23 is mainly composed of a rotary rack 23*a* that is a body of rotation rotating clockwise in FIG. 1. The rotary rack 23*a* has four developing devices disposed at regular intervals in a circumferential direction thereof. The four developing devices include a black color developing device 23B, a cyan color developing device 23C, a magenta color developing device 23M, and a yellow color developing device 23Y. The rotary rack 23*a* is made to rotate by driving means, which is not shown in the drawing, for moving the four developing devices sequentially to a position facing the photoconductor drum 21, and forming different colored toner images on the surface of the photoconductor drum 21.

There is disposed, right below the photoconductor drum 21, an intermediate transfer belt 24 that is an intermediate transfer body used in the form of an endless belt. The intermediate transfer belt 24 makes contact with the photoconductor drum 21 from below by pressurizing, thereby forming a primary transfer nip portion. The intermediate transfer belt 24 is supported in such a way that it is stretched around a plurality of rollers, and rotates clockwise in FIG. 1.

A secondary transfer portion 40 is disposed in a position where the intermediate transfer belt 24 passes over the paper transportation path. The secondary transfer portion 40 has a secondary transfer roller 41. The intermediate transfer belt 24 and the secondary transfer roller 41 are brought into contact with each other by pressurizing, thereby forming a secondary transfer nip portion, and paper P is inserted through the secondary transfer nip portion thus formed. In FIG. 1, the secondary transfer roller 41 can move in the up/down direction, and is brought into contact with the intermediate transfer belt 24 by pressurizing or separated therefrom where appropriate. A cleaning apparatus 25 for a belt is provided on a downstream side of the secondary transfer portion 40 in the paper transport direction. This belt cleaning apparatus 25 too is brought into contact with the intermediate transfer belt 24 or separated therefrom where appropriate.

There is provided, above the image forming portion 20, an optical portion 7, which irradiates the photoconductor drum 21 with laser light L. Alternate long and short dash lines shown in the drawing represent the laser light L.

A fixing portion 8, an ejected paper transportation path 9, and a paper ejecting portion 10 are disposed on a downstream side of the image forming portion 20 and the secondary transfer portion 40 in the paper transport direction. The paper ejecting portion 10 is provided on a top of the main body 2 in a position where printed paper P can be taken out from the outside.

There is disposed a duplex printing paper transportation path 11 in a position below the fixing portion 8 and the secondary transfer portion 40 and above the paper cassette 3. The duplex printing paper transportation path 11 branches off halfway from the ejected paper transportation path 9, and joins the feeding paper transportation path 4 just upstream of the resist roller 6.

The printer 1 structured as described above performs printing operation as follows.

A stack of pre-printed paper P is accommodated in the paper cassette 3, and sheets of paper are sent therefrom individually. The paper P thus sent therefrom enters the feeding paper transportation path 4, is then transported by the paper feeding transportation roller 5, and then reaches the resist roller 6. The resist roller 6 corrects diagonal feeding of the paper P, and at the same time, sends the paper P to the secondary transfer portion 40 in coordination with a color toner image formed by the image forming portion 20 on the surface of the intermediate transfer belt 24.

On the other hand, a signal representing image data such as characters, graphics, or patterns transmitted from an external computer (not shown) is transmitted to the printer 1. Based on this image data, the optical portion 7 controls and emits the laser light L. As a result, in the image forming portion 20, an electrostatic latent image of an original image is formed on the surface of the photoconductor drum 21. At this time, different colored electrostatic latent images are formed sequentially and individually in accordance with an image forming process of each color.

Next, the rotary rack 23*a* rotates so that the black color developing device 23B faces the photoconductor drum 21 in an attempt to form, on the surface of the photoconductor drum 21, a toner image of black, which is the first color of the four colors of black, cyan, magenta, and yellow. The black color developing device 23B develops the electrostatic latent image formed on the surface of the photoconductor drum 21, thereby forming a toner image of black. Then, the toner image thus formed is primary transferred to the surface of the intermediate transfer belt 24.

After primary transfer, the toner remaining on the surface of the photoconductor drum 21 is removed by the cleaning apparatus 30 for a drum. The intermediate transfer belt 24 rotates one-turn so as to reach a predetermined primary transfer position with respect to the photoconductor drum 21 in an attempt to perform primary transfer of a next color. Then, the same process as in the case of the first color is repeated for the second color through the fourth color, whereby a color toner image in which the four different colored toner images of black, cyan, magenta, and yellow are superimposed on each other is formed on the surface of the intermediate transfer belt 24. During the interval that the different colored toner images are sequentially primary transferred to the intermediate transfer belt 24, the secondary transfer roller 41 of the secondary transfer portion 40 and the belt cleaning apparatus 25 are separated from the intermediate transfer belt 24.

When the four colored toner image is formed on the surface of the intermediate transfer belt 24, the secondary transfer roller 41 makes contact with the intermediate transfer belt 24 by pressurizing. The color toner image is transferred, in the secondary transfer nip portion formed with the intermediate transfer belt 24 and the secondary transfer roller 41 brought into contact with each other by pressurizing, to the paper P sent by the resist roller 6 in synchronously with the color toner image. At this time, a transfer bias for transferring the toner to the paper P is applied to the secondary transfer roller 41. After secondary transfer, the toner remaining on the surface of the intermediate transfer belt 24 is removed by the belt cleaning apparatus 25 that is brought into contact with the intermediate transfer belt 24 by pressuring.

Then, the paper P carrying the unfixed color toner image is sent to the fixing portion 8, where the toner image is fixed by a heating roller and a pressure roller. The paper P ejected from the fixing portion 8 is sent upward through the ejected paper transportation path 9, and is then ejected to the paper ejecting portion 10 provided on the top of the main body 2.

When duplex printing is performed, a transport direction of the paper P ejected from the fixing portion 8 is changed to the opposite direction immediately before the paper P is ejected to the paper ejecting portion 10 through the ejected paper transportation path 9. The paper P is then sent to the duplex printing paper transportation path 11, then is made to join the feeding paper transportation path 4 just upstream of the resist roller 6, and is then sent to the secondary transfer portion 40 again.

Figure 2:
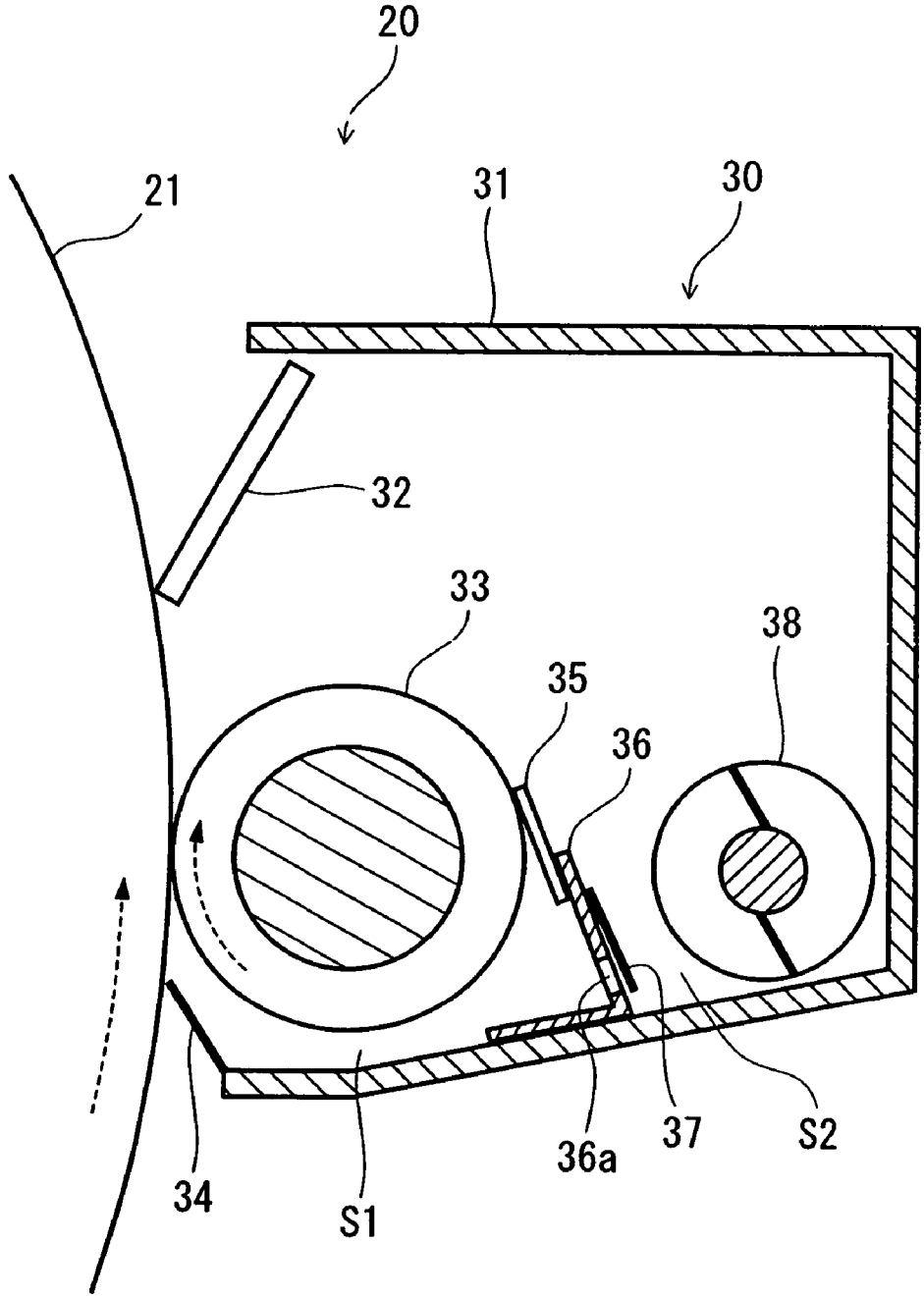
FIG. 2 is a partially enlarged schematic vertical sectional view showing the vicinity of the cleaning apparatus of a first embodiment of the present invention.
Figure 3:
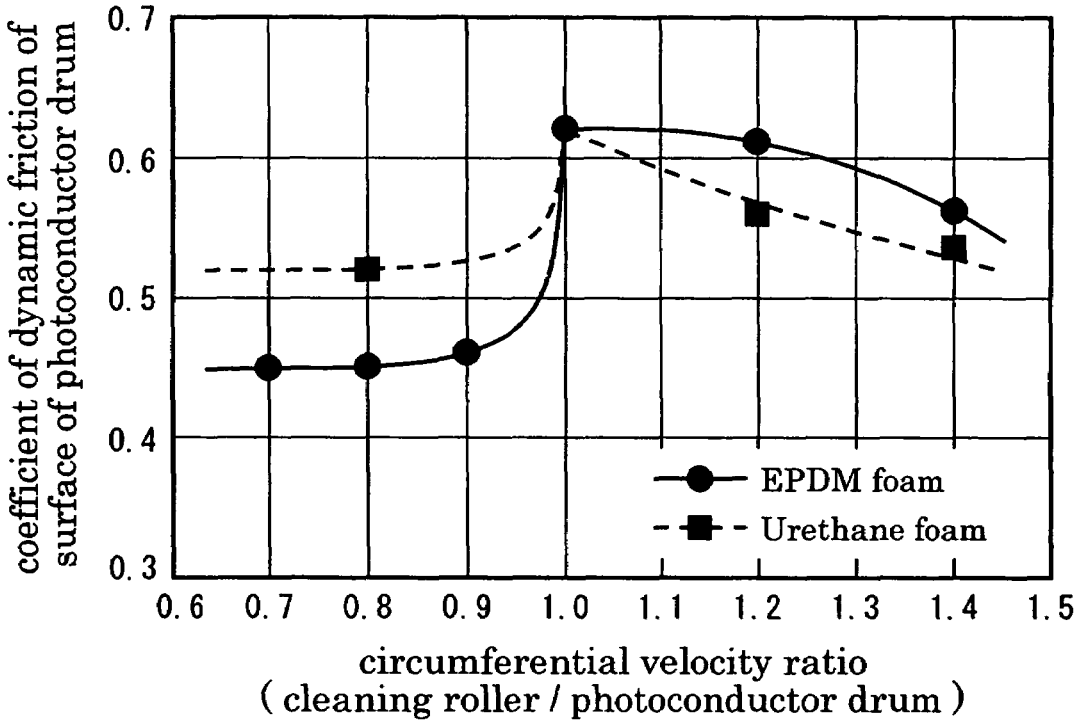
FIG. 3 is a graph showing the influence of a circumferential velocity ratio between the cleaning roller and the photoconductor drum to a coefficient of dynamic friction of the surface of the photoconductor drum.
Figure 4:
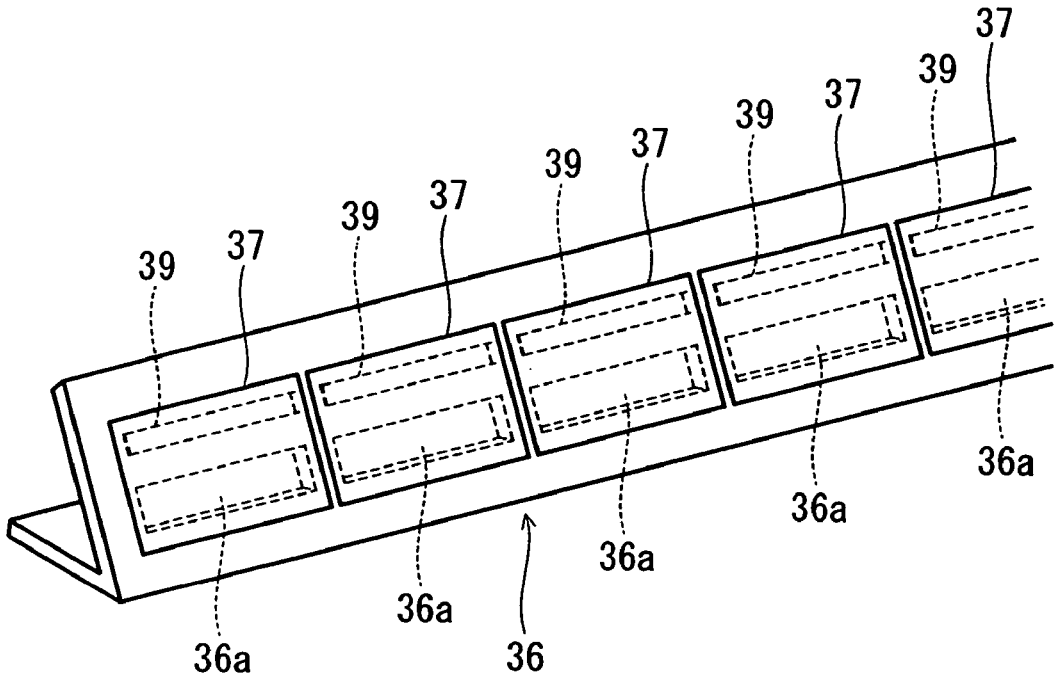
FIG. 4 is a perspective view seen from a discharge screw side of the partition wall shown in FIG. 2.
Figure 5:
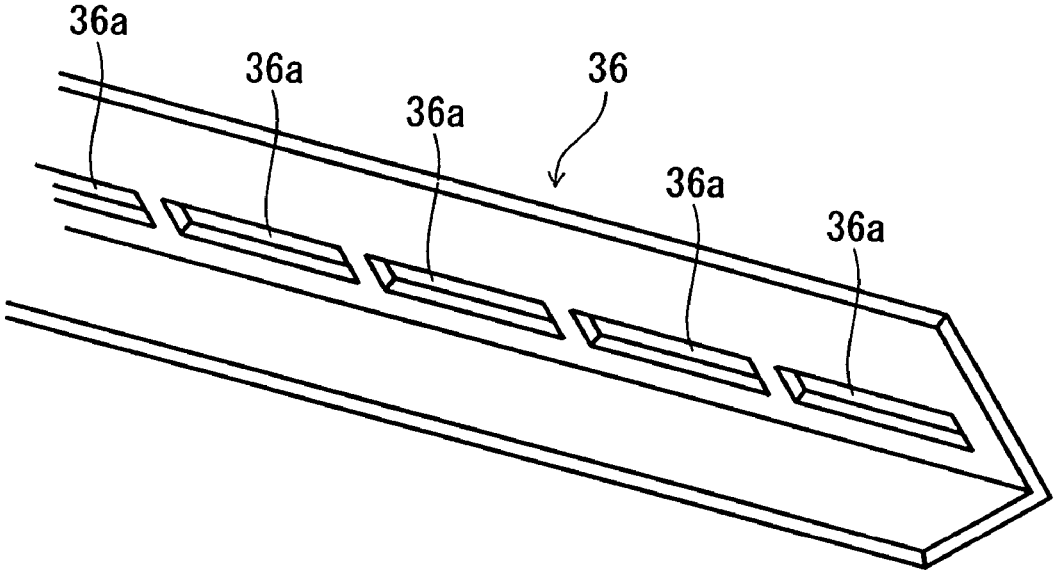
FIG. 5 is a perspective view seen from a cleaning roller side of the partition wall shown in FIG. 2.

Next, the detailed structure of the cleaning apparatus of a first embodiment of the present invention will be described by referring to FIGS. 2 to 5 in addition to FIG. 1. FIG. 2 is a partially enlarged schematic vertical sectional view showing the vicinity of the cleaning apparatus, and FIG. 3 is a graph showing the influence of a circumferential velocity ratio between a cleaning roller and a photoconductor drum to a coefficient of dynamic friction of the surface of the photoconductor drum. FIG. 4 is a perspective view seen from a discharge screw side of a partition wall, and FIG. 5 is a perspective view seen from a cleaning roller side of the partition wall.

As shown in FIG. 1, the image forming portion 20 has, at the center thereof, the photoconductor drum 21 which is an image carrying body. As shown in FIGS. 1 and 2, the cleaning apparatus 30 for a drum is disposed in the vicinity of the photoconductor drum 21.

The photoconductor drum 21 is an inorganic photoconductor formed by, for example, vacuum depositing amorphous silicon, which is an inorganic photoconducting material, on the outer surface of an electrically conductive roller-shaped base substance formed of aluminum, for example, and measures 30 mm in diameter. The photoconductor drum 21 is made to rotate by a driving apparatus, which is not shown in the drawing, so that the circumferential velocity thereof becomes equal to the velocity at which paper is transported (150 mm/s).

The cleaning apparatus 30 for the photoconductor drum 21 is disposed at a downstream side of the primary transfer nip portion along the rotation direction of the photoconductor drum 21 (see FIG. 1). As shown in FIG. 2, the cleaning apparatus 30 includes, inside a housing 31 thereof, a cleaning blade 32, a cleaning roller 33 that is a rotating member, a lower seal member 34, a scraper 35, a partition wall 36, opening/closing members 37, and a discharge screw 38 that is a discharging member.

The cleaning blade 32 is formed of polyurethane rubber having a hardness of 77° (in accordance with JIS-A), has about the same length as the photoconductor drum 21 in the axis direction, and has a thickness of 2.2 mm, and makes contact with the photoconductor drum 21. The cleaning blade 32 is provided so as to be brought into contact with the photoconductor drum 21 at an angle of 15° and at a linear pressure of 48 N/m. The cleaning blade 32 performs cleaning in such a way as to scrape extraneous matters such as toner remaining on the surface of the photoconductor drum 21.

The cleaning roller 33 is built by laying ethylene propylene rubber foam (EPDM foam) having a hardness of 55° (in accordance with JIS-A) around the metal core having the diameter of 8 mm, and has a roller portion having the diameter of 12 mm. The cleaning roller 33 has biasing means, which are not shown in the drawing, at both ends of an axis portion thereof, and is pressed against the photoconductor drum 21 by the biasing means with a pressure of 1,800 gf (900 gf at each end). The cleaning roller 33 recovers toner lying on the surface of the photoconductor drum 21 or in the vicinity of the cleaning blade 32, and then cleans (scrubs) the surface of the photoconductor drum 21 with the toner attached to the surface of the cleaning roller 33.

The cleaning roller 33 is made to rotate by driving means that is not shown in the drawing and built with a motor, for example. The driving means of the cleaning roller 33 can change the circumferential velocity of the cleaning roller 33, switch the rotation direction thereof, or make the cleaning roller 33 rotate in accordance with the rotation of the photoconductor drum 21.

To clean the surface of the photoconductor drum 21 efficiently, it is preferable that a coefficient of dynamic friction of the surface of the photoconductor drum 21 be as low as possible, and therefore it is necessary to make the cleaning roller 33 rotate with a predetermined circumferential velocity. FIG. 3 shows the influence of a circumferential velocity ratio between the cleaning roller 33 and the photoconductor drum 21 (the circumferential velocity of the cleaning roller/the circumferential velocity of the photoconductor drum) to a coefficient of dynamic friction of the surface of the photoconductor drum 21 when the cleaning roller 33 is made to rotate in a direction in which the portion of the surface thereof where it comes into contact with the photoconductor drum 21 moves in the same direction as the surface of the photoconductor drum 21. As a material of the cleaning roller 33, EPDM foam and urethane foam are compared.

As shown in FIG. 3, the coefficient of dynamic friction of the surface of the photoconductor drum 21 becomes highest when the circumferential velocity ratio is 1.0, that is, when the cleaning roller 33 and the photoconductor drum 21 rotate at the same circumferential velocity. As seen in the drawing, the coefficient of dynamic friction drops as the circumferential velocity ratio becomes lower than 1.0 and becomes higher than 1.0. Thus, based on the result shown in FIG. 3, to achieve the lowest coefficient of dynamic friction, it has been decided that a material of the cleaning roller 33 is EPDM foam and the cleaning roller 33 rotates at 0.8 times the circumferential velocity of the photoconductor drum 21.

On the other hand, as shown in FIG. 2, the lower seal member 34 is provided, in the rotation direction of the drum, on an upstream side of the portion where the cleaning roller 33 and the photoconductor drum 21 are brought into contact with each other. The lower seal member 34 is provided between the housing 31 and the photoconductor drum 21 so as to prevent toner inside the housing 31 from falling. The lower seal member 34 is formed of a polyurethane film having the thickness of 50 μm.

The scraper 35 is formed of a stainless plate having the thickness of 0.05 mm, and has about the same length as the cleaning roller 33 in the axis direction. As shown in FIG. 2, the scraper 35 is supported by upper part of the partition wall 36 with the cleaning roller 33 interposed between the scraper 35 and the photoconductor drum 21, and the tip of the scraper 35 is brought into contact with the cleaning roller 33 by pressurizing. The scraper 35 scrapes toner, which has been removed from the surface of the photoconductor drum 21 and then attached to the surface of the cleaning roller 33, off the surface of the cleaning roller 33.

As described above, the partition wall 36 supporting the scraper 35 is disposed with the cleaning roller 33 interposed between the partition wall 36 and the photoconductor drum 21. As shown in FIGS. 2, 4, and 5, the partition wall 36 is a member that is substantially L-shaped as viewed from the axis direction of the cleaning roller 33, and has about the same length of the cleaning roller 33 in the axis direction. The partition wall 36 has, at both ends in the direction along the longer sides thereof, lock pieces, which are not shown in the drawing, extending toward the axis portion of the cleaning roller 33. The partition wall 36 is rotatably provided with respect to the axis direction of the cleaning roller 33 by making the axis portion of the cleaning roller 33 pierce through the lock piece. When the cleaning roller 33 rotates clockwise in FIG. 2, the partition wall 36 is supported in such a way that a bottom face thereof is pressed against an inner bottom face of the housing 31. Note that the partition wall 36 may be directly fixed to the housing 31.

As shown in FIG. 2, the partition wall 36 partitions a space inside the housing 31 into a space S1 formed on an upstream side of the cleaning roller 33 in the rotation direction of the drum and a space S2 in which the discharge screw 38 is provided. As shown in FIGS. 4 and 5, the partition wall 36 has a plurality of openings 36*a* arranged in the axis direction of the cleaning roller 33.

The partition wall 36 has opening/closing members 37 individually provided for the plurality of openings 36*a*. Each of the opening/closing members 37 is formed of a polyurethane film having the thickness of 0.1 mm, and has the shape of a sheet that is wide enough to cover the opening 36*a*. As shown in FIGS. 2 and 4, the opening/closing members 37 are attached along a side face on the discharge screw 38 side of the partition wall 36 so as to cover the openings 36*a*. Upper part of each opening/closing member 37 is attached to the partition wall 36 with a double-faced tape 39, for example, and lower part thereof serves as a free end and deforms elastically, thereby permitting opening/closing of the opening 36*a*. This permits toner to move through the opening 36*a* only in a direction from the space S1 located on the cleaning roller 33 side of the partition wall 36 to the space S2 located on the discharge screw 38 side thereof.

As shown in FIG. 2, the discharge screw 38 is provided inside the housing 31 in a position further away from the photoconductor drum 21 than the partition wall 36. The discharge screw 38 is disposed so as to be level with the cleaning roller 33. The discharge screw 38 discharges toner inside the housing 31, the toner removed from the surface of the photoconductor drum 21 and then used for cleaning, outside the housing 31.

Now, toner that is developer used for image formation will be described. Amorphous toner was used as black toner housed in the black color developing device 23B of the rotary rack 23*a* shown in FIG. 1, and spherical toner was used as cyan toner, magenta toner, and yellow toner housed in the color developing devices 23C, 23M, and 23Y, respectively.

The black amorphous toner was manufactured as follows. First, 5 parts by weight of carbon black (relative to the weight of 100 parts by weight of polyester resin) and nigrosine N21 (manufactured by Orient Chemical Industries, Ltd), as charge control agent (CCA), were mixed to polyester resin. The mixture was then kneaded by a two-roll kneading machine for 30 minutes at 100° C., was then coarsely ground, and was then finely ground by a target plate-type jet mill. Then, classification was performed by an air classifier, thereby obtaining particles having a mean volume diameter of 6.8 μm. To the particles thus obtained, 1.5 parts by weight of silica hydrophobic particles were added, and then the mixture thus obtained was mixed by a particle mixer, thereby obtaining amorphous toner. As a result of measurement by a Flow Particle Image Analyzer manufactured by Sysmex Corporation, the degree of sphericity of the amorphous toner thus obtained was 0.94 to 0.95. The amount of electric charge measured by a suction method was about +12 μC/g.

Spherical toner of three colors were manufactured as follows. First, 2 parts by weight of polymerization initiator and 2 parts by weight of 2,2'-azobis (2,4-dimethyl-valeronitrile) were added to the mixed solution of 80 parts by weight of styrene, 20 parts by weight of 2-ethylhexyl methacrylate, 5 parts by weight of coloring agent, 3 parts by weight of low molecular-weight polypropylene, 2 parts by weight of charge control agent (quaternary ammonium salt), and 1 part by weight of divinylbenzene (cross-linking agent). The mixture thus obtained was added to 400 parts by weight of purified water, and then 5 parts by weight of tribasic calcium phosphate and 0.1 parts by weight of sodium dodecylbenzenesulfonate were added thereto as a suspension stabilizer. Then, the mixture thus obtained was agitated at 7000 rpm (revolution per minutes) for 20 minutes by using an emulsifier/disperser manufactured by Primix Corporation, and was then polymerized at 100 rpm for 10 hours at 70° C. in a nitrogen atmosphere, thereby obtaining spherical toner having a mean volume diameter of 6.4 μm. As a result of measurement by a Flow Particle Image Analyzer manufactured by Sysmex Corporation, the degree of sphericity of the spherical toner thus manufactured was 0.96 to 0.99. The amounts of electric charge of three colors: cyan, magenta, and yellow, measured by a suction method, were about 33 +μC/g, about 29 +μC/g, and about 32 +μC/g, respectively.

Figure 6:
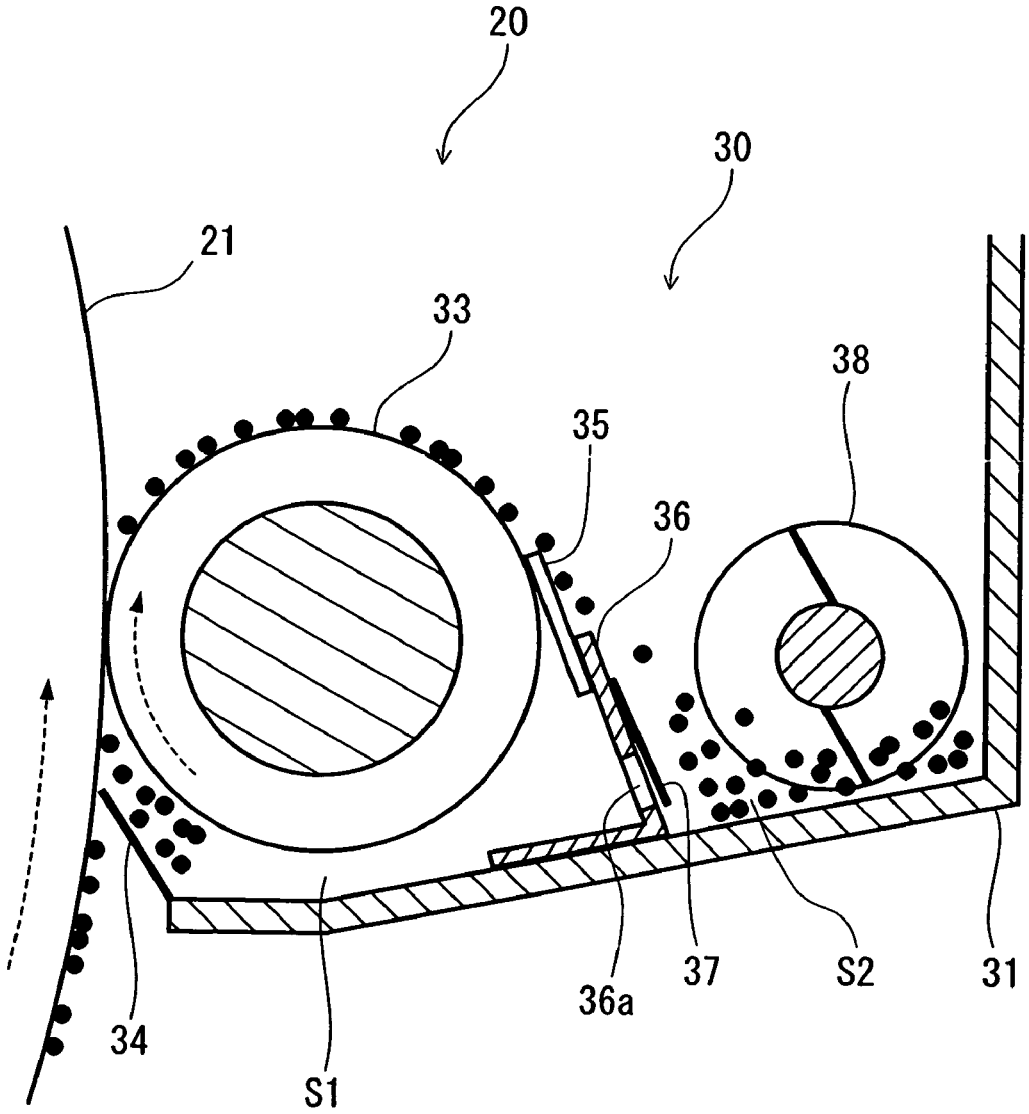
FIG. 6 is a partially enlarged schematic vertical sectional view showing a state in which cleaning has just been started in the vicinity of the cleaning apparatus.
Figure 7:
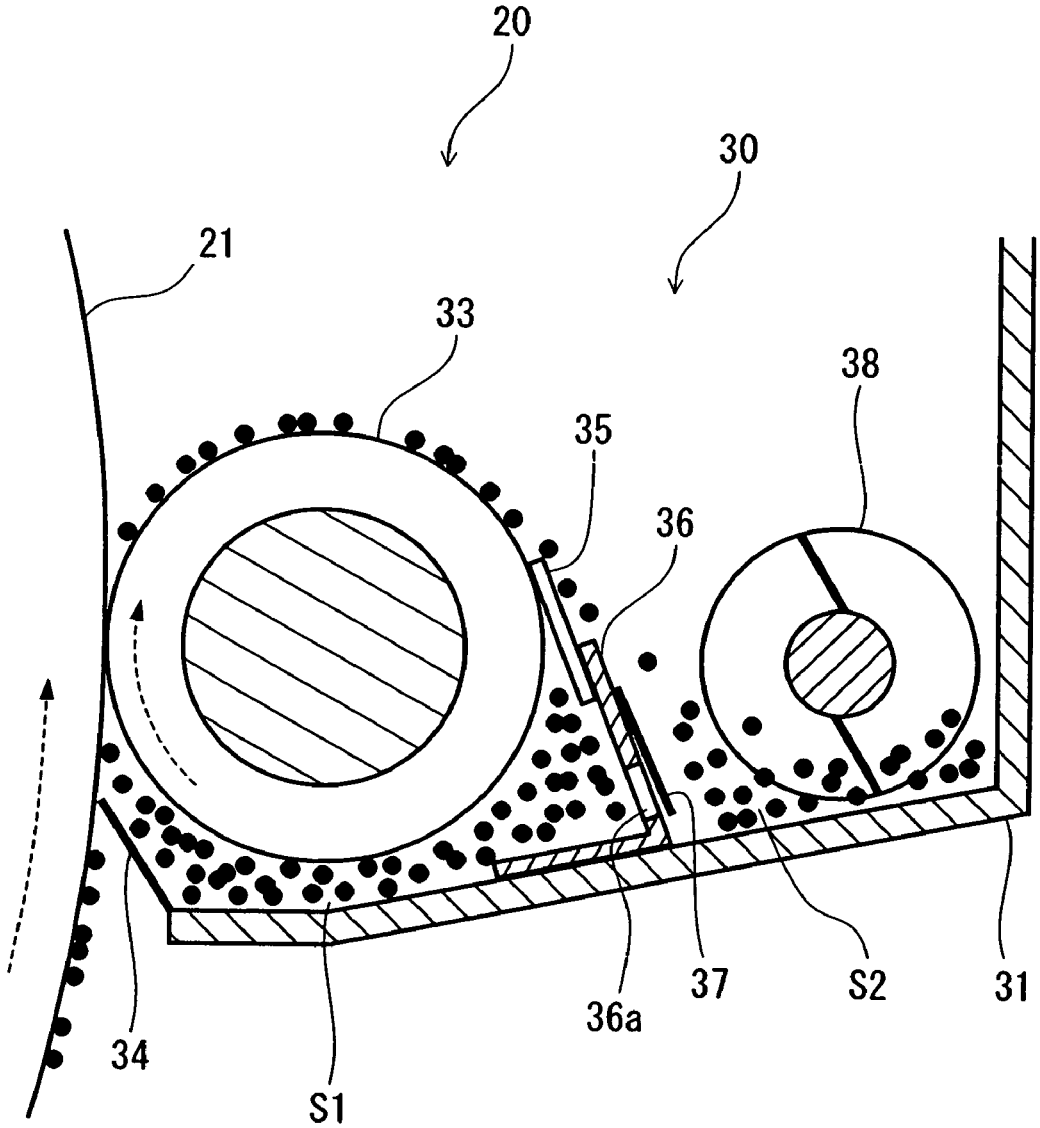
FIG. 7 is a partially enlarged schematic vertical sectional view showing a state in which some time has elapsed since the state shown in FIG. 6 in the vicinity of the cleaning apparatus.
Figure 8:
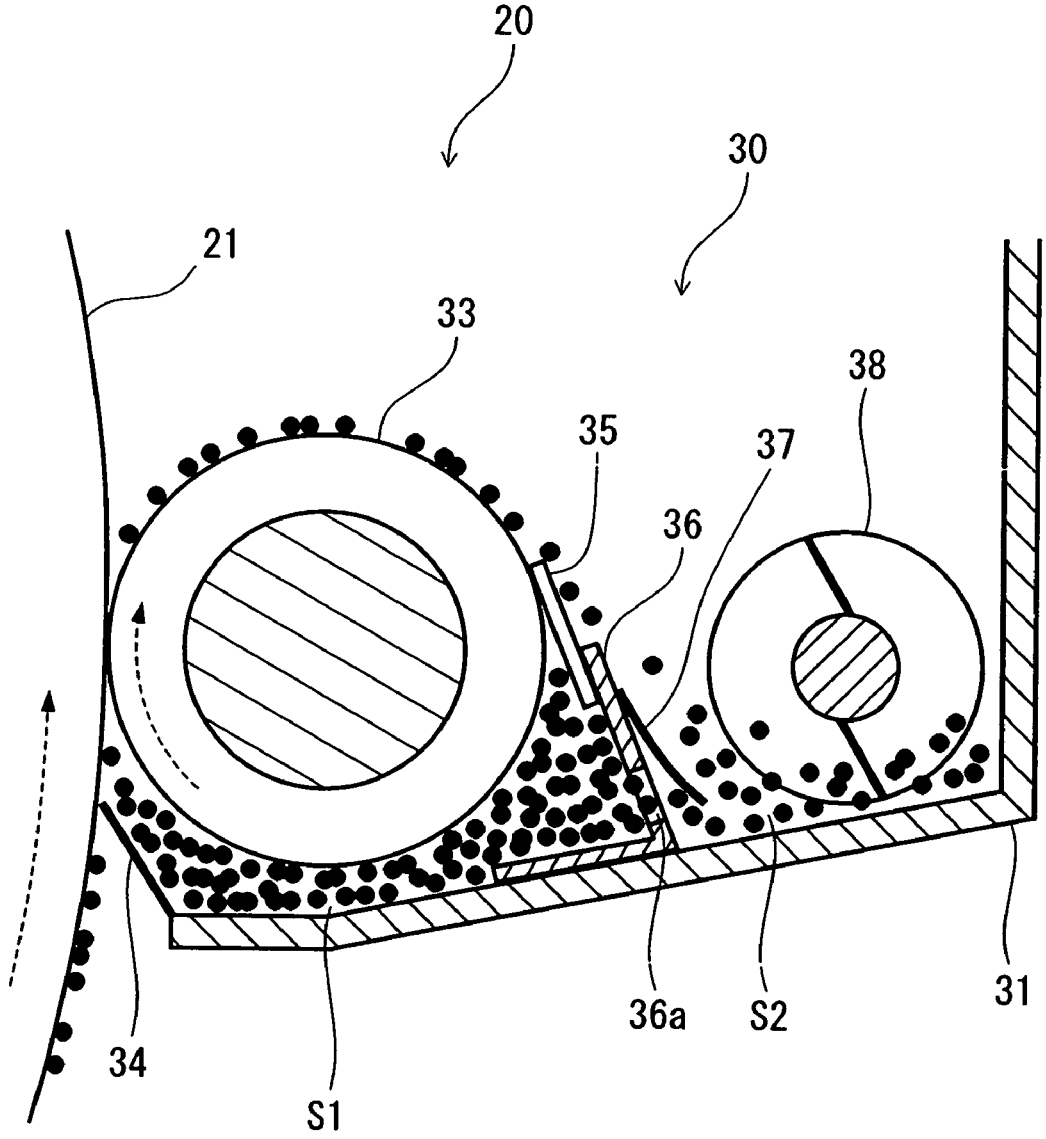
FIG. 8 is a partially enlarged schematic vertical sectional view showing a state in which some time has elapsed since the state shown in FIG. 7 in the vicinity of the cleaning apparatus and toner has started moving through the opening formed in the partition wall.

Next, how the surface of the photoconductor drum 21 is cleaned by the cleaning apparatus 30 will be described with reference to FIGS. 6 to 8. FIG. 6 is a partially enlarged schematic vertical sectional view showing a state in which cleaning has just been started in the vicinity of the cleaning apparatus. FIG. 7 is a partially enlarged schematic vertical sectional view showing a state in which some time has elapsed since the state shown in FIG. 6 in the vicinity of the cleaning apparatus. FIG. 8 is a partially enlarged schematic vertical sectional view showing a state in which some time has elapsed since the state shown in FIG. 7 in the vicinity of the cleaning apparatus and toner has started moving through the openings formed in the partition wall.

As shown in FIG. 6, during the image forming operation, the portion of the surface of the cleaning roller 33 where it comes into contact with the photoconductor drum 21 moves in the same direction as the surface of the photoconductor drum 21. As described earlier, the cleaning roller 33 rotates at 0.8 times the circumferential velocity of the photoconductor drum 21.

After the toner image formed on the surface of the photoconductor drum 21 is transferred to the intermediate transfer belt 24, part of toner remaining on the surface of the photoconductor drum 21 passes through a nip portion formed with the photoconductor drum 21 and the cleaning roller 33 brought into contact with each other. At this time, the surface of the photoconductor drum 21 is cleaned (scrubbed) by the toner passing through the nip portion. Since the circumferential velocity ratio between the photoconductor drum 21 and the cleaning roller 33 is set to 0.8, the coefficient of dynamic friction of the surface of the photoconductor drum 21 is reduced (see FIG. 3), making it possible to perform efficient cleaning.

The toner used for cleaning of the surface of the photoconductor drum 21 and then attached to the surface of the cleaning roller 33 is scraped by the scraper 35, and is then sent toward the discharge screw 38. Then, the residual toner is discharged outside the housing 31 by the discharge screw 38.

On the other hand, part of the toner remaining on the surface of the photoconductor drum 21 does not pass through the nip portion formed with the photoconductor drum 21 and the cleaning roller 33 brought into contact with each other. Such toner gradually accumulates in the space S1 formed inside the housing 31 on an upstream side of the cleaning roller 33 in the rotation direction of the drum, resulting in an increase in toner density of the space S1 as shown in FIG. 7.

When cleaning is continuously performed, the space S1 inside the housing 31 becomes filled with toner. This makes the toner inside the space S1 head for the openings 36*a* formed in the partition wall 36, which are the only places to escape, as shown in FIG. 8, and then push the lower parts of the opening/closing members 37 toward the discharge screw 38. The toner inside the space S1 located below the cleaning roller 33 passes through the openings 36*a*, then moves to the space S2 in which the discharge screw 38 is provided, and is then discharged outside the housing 31 by the discharge screw 38. Since the opening/closing members 37 are attached along a side face on the discharge screw 38 side of the partition wall 36 so as to cover the openings 36*a*, the toner is prevented from flowing back to the space S1 from the space S2.

As described above, there are provided the housing 31, the cleaning roller 33 that is a rotating member brought into contact with the photoconductor drum 21, which is an image carrying body, for removing toner attached to the surface of the photoconductor drum 21, the scraper 35 that scrapes toner off the surface of the cleaning roller 33, the discharge screw 38 that is a discharging member and discharges the toner scraped from the cleaning roller 33 outside the housing 31, the partition wall 36 having the openings 36*a* in part thereof, the partition wall 36 that supports the scraper 35 and partitions a space inside the housing 31 into a space S1 formed on an upstream side of the cleaning roller 33 in the rotation direction of the drum and a space S2 in which the discharge screw 38 is provided, and the opening/closing members 37 individually provided for the openings 36*a* of the partition wall 36 so as to permit the toner to move through the openings 36*a* only in a direction toward the discharge screw 38. This makes it possible to make toner used for cleaning of the surface of the photoconductor drum 21 and then scraped from the cleaning roller 33 by the scraper 35 smoothly move toward where the discharge screw 38 is provided. This makes it possible to prevent toner removed from the surface of the photoconductor drum 21 from keeping in contact with the surface of the photoconductor drum 21 and accumulating thereon, or toner used for cleaning of the surface of the photoconductor drum 21 from making contact with the photoconductor drum 21 again. Moreover, it is possible to retain an appropriate amount of toner in the space S1 inside the housing 31 without overflowing it. In this way, unwanted toner is reliably sent toward the discharge screw 38 as speedily as possible, making it possible to maintain suitable cleaning performance of cleaning the surface of the photoconductor drum 21.

Moreover, in the cleaning apparatus 30 structured as described above, the discharge screw 38 and the cleaning roller 33 are disposed so as to be level with each other. As a result, unlike the conventional structure allowing toner to free-fall from the cleaning roller 33 toward the discharge screw 38, even when these two members cannot be disposed in such a way as to allow toner to free-fall, it is possible to make toner scraped from the cleaning roller 33 smoothly move toward where the discharge screw 38 is provided. Furthermore, with the structure of the present invention, even when the discharge screw 38 is disposed above the level of the cleaning roller 33, it is possible to make toner smoothly move toward the discharge screw 38. This makes it possible to cope with any variation in the disposition of the discharge screw 38 and the cleaning roller 33 in the up/down direction. Therefore, it is possible to maintain suitable cleaning performance of cleaning the surface of the photoconductor drum 21 without being influenced by the structure of the cleaning apparatus 30 or the disposition thereof with respect to the photoconductor drum 21, making it possible to cope with the recent trend for making the printer 1 increasingly compact.

In the cleaning apparatus 30 structured as described above, the cleaning roller 33 rotates at a slower velocity than the surface of the surface of the photoconductor drum 21 in a direction in which the portion of the surface of the cleaning roller 33 where it comes into contact with the photoconductor drum 21 moves in the same direction as the surface of the photoconductor drum 21. This makes it easier to retain toner in the space S1 formed by the partition wall 36 inside the housing 31. As a result, even when only a small amount of toner remains on the surface of the photoconductor drum 21, it is possible to use the retained toner for cleaning of the surface of the photoconductor drum 21. This makes it possible to prevent reduction in cleaning performance. Furthermore, when spherical toner is used that can be expected to offer high image quality but has a high possibility of reducing the cleaning performance, it is possible to feed a large amount of toner retained in the space S1 to a nip between the photoconductor drum 21 and the cleaning roller 33. Thus, also in this case, the structure of the present invention is highly effective as in the case where only a small amount of toner is available.

Even when the cleaning roller 33 is made to rotate in a direction in which the portion of the surface of the cleaning roller 33 where it comes into contact with the photoconductor drum 21 moves in a direction different from that of the surface of the photoconductor drum 21, the same cleaning effect as in the structure described above can be obtained, because it becomes increasingly easy to retain toner in the space S1 as the coefficient of dynamic friction of the surface of the photoconductor drum 21 is reduced.

According to the present invention, the above-described cleaning apparatus 30 is provided to the printer 1. This makes it possible to obtain a high-performance printer 1 that can maintain suitable cleaning performance of cleaning the surface of the photoconductor drum 21 by reliably sending unwanted toner toward the discharge screw 38 as speedily as possible without allowing toner removed from the surface of the photoconductor drum 21 to keep in contact with the surface of the photoconductor drum 21 and accumulate thereon, or without allowing toner used for cleaning of the surface of the photoconductor drum 21 to make contact with the photoconductor drum 21 again.

Figure 9:
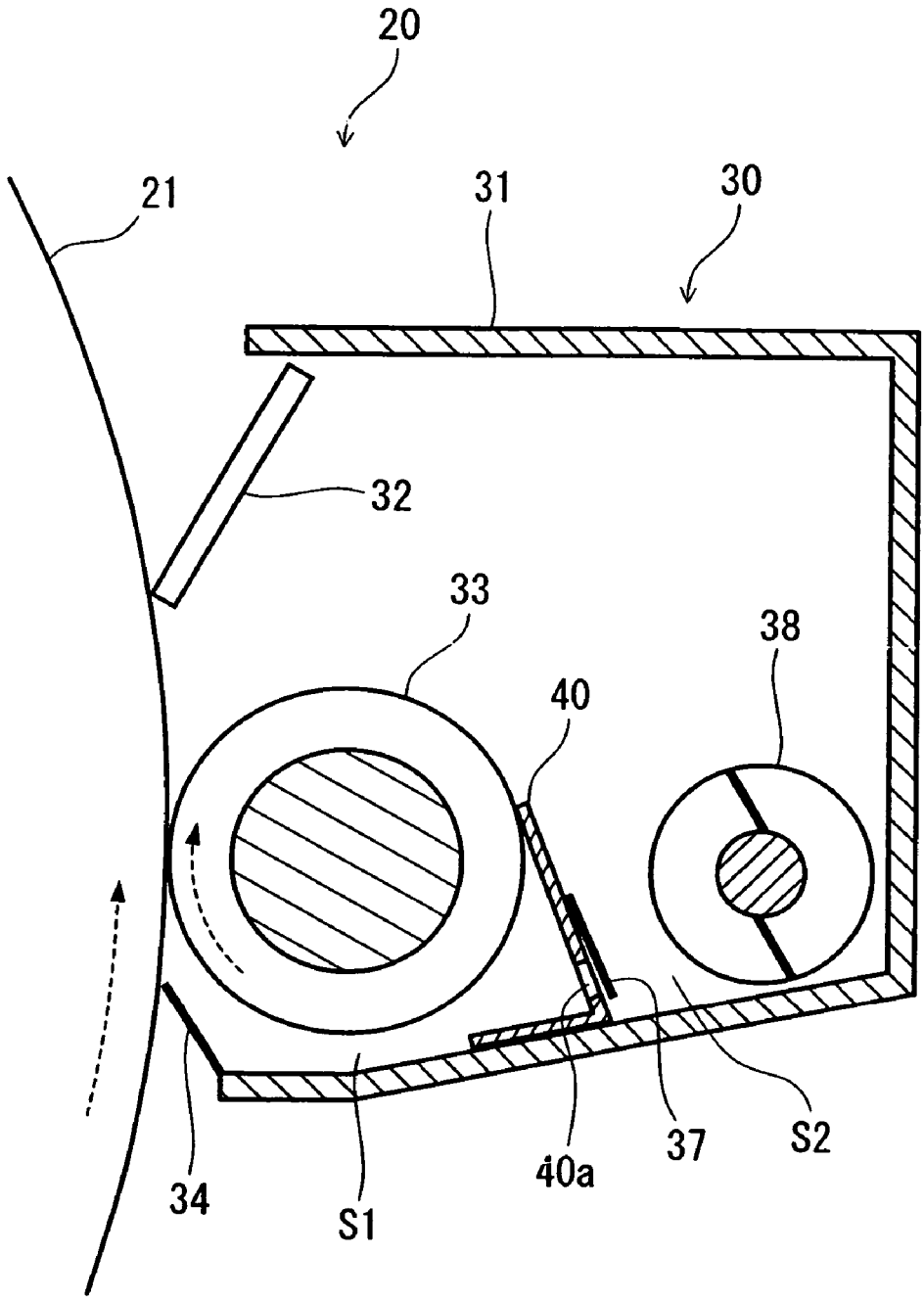
FIG. 9 is a partially enlarged schematic vertical sectional view showing the vicinity of the cleaning apparatus of a second embodiment of the present invention.

Next, the detailed structure of the cleaning apparatus of a second embodiment of the present invention will be described with reference to FIG. 9. FIG. 9 is a partially enlarged schematic vertical sectional view showing the vicinity of the cleaning apparatus. It is to be noted that the basic structure of this embodiment is identical to that of the first embodiment described above with reference to FIGS. 2 to 8, and therefore such members as are found also in the first embodiment will be identified with common reference numerals and their detailed descriptions will be omitted.

In the second embodiment, as shown in FIG. 9, a scraper 40 that is brought into contact with the cleaning roller 33 by pressurizing is a member that is substantially L-shaped as viewed from the axis direction of the cleaning roller 33, and is fixed to the housing 31. The scraper 40 has a plurality of openings 40*a*, and partitions a space inside the housing 31 into a space S1 formed on an upstream side of the cleaning roller 33 in the rotation direction of the drum and a space S2 in which the discharge screw 38 is provided. Thus, the scraper 40 not only scrapes toner off the surface of the cleaning roller 33 by bringing the tip thereof into contact with the cleaning roller 33 by pressurizing, but also partitions a predetermined space inside the housing 31. Specifically, the scraper 40 of the present embodiment is built as an integrated member of the scraper 35 and the partition wall 36 of the first embodiment.

As described above, the scraper 35 and the partition wall 36 are integrated together into a single member, making it possible to reduce the number of parts and simplify the assembly procedure. This makes it possible to realize a structure, without a great increase in cost, that can prevent toner removed from the surface of the photoconductor drum 21 from keeping in contact with the surface of the photoconductor drum 21 and accumulating thereon, or toner used for cleaning of the surface of the photoconductor drum 21 from making contact with the photoconductor drum 21 again.

It is to be understood that the present invention may be practiced in any other manner than specifically described above as embodiments, and various modifications are possible within the scope of the invention.

For example, the embodiments described above deal with cases where upper part of each opening/closing member 37 is attached to the partition wall 36 with the double-faced tape 39, and lower part thereof serves as a free end. It should be understood, however, that the opening/closing member 37 may be attached in any other way than is specifically described above. For example, the opening/closing member 37 may be attached by using an adhesive or the like. Alternatively, lower part of the opening/closing member 37 may be attached to the partition wall 36, and upper part thereof may serve as a free end. Moreover, instead of having the shape of a sheet, the opening/closing members 37 individually provided for the plurality of openings 36*a* may have the shape of strip of various widths.

The present invention finds wide application in cleaning apparatuses of any other types used in image forming apparatuses.

What is claimed is:

1. A cleaning apparatus comprising:

a housing;

a rotating member that removes toner attached to a surface of an image carrying body by making contact with the image carrying body;

a scraper that scrapes toner off a surface of the rotating member;

a discharging member that discharges the toner scraped off the rotating member outside the housing;

a partition wall that supports the scraper, has openings in part thereof, and partitions a space inside the housing into a space formed on an upstream side of the rotating member in a rotation direction of the image carrying body and a space in which the discharging member is provided; and an opening/closing member that is attached to each opening of the partition wall so as to permit toner to move through the opening only in a direction toward the discharging member, wherein the discharging member and the rotating member are disposed so as to be level with each other, or the discharging member is disposed above a level of the rotating member.

2. The cleaning apparatus of claim 1, wherein the scraper and the partition wall are integrated together into a single member.

3. The cleaning apparatus of claim 1, wherein the rotating member rotates in a direction in which a portion of the surface thereof where the rotating member comes into contact with the image carrying body moves in a direction different from a direction of the surface of the image carrying body, or rotates at a slower velocity than the surface of the image carrying body in a direction in which the portion of the surface of the rotating member where the rotating member comes into contact with the image carrying body moves in a same direction as the surface of the image carrying body.

4. An image forming apparatus provided with:

a cleaning apparatus, wherein the cleaning apparatus includes a housing, a rotating member that removes toner attached to a surface of an image carrying body by making contact with the image carrying body, a scraper that scrapes toner off a surface of the rotating member, a discharging member, disposed so as to be above or level with the rotating member, that discharges the toner scraped off the rotating member outside the housing, a partition wall that supports the scraper, has openings in part thereof, and partitions a space inside the housing into a space formed on an upstream side of the rotating member in a rotation direction of the image carrying body and a space in which the discharging member is provided, and an opening/closing member that is attached to each opening of the partition wall so as to permit toner to move through the opening only in a direction toward the discharging member.

* * * * *